US006258987B1

(12) United States Patent
Schmidt et al.

(10) Patent No.: US 6,258,987 B1
(45) Date of Patent: Jul. 10, 2001

(54) PREPARATION OF ALCOHOL-CONTAINING GASOLINE

(75) Inventors: Gerald K. Schmidt; Ken Tadano, both of Naperville, IL (US)

(73) Assignee: BP Amoco Corporation, Chicago, IL (US)

( * ) Notice: Subject to any disclaimer, the term of this patent is extended or adjusted under 35 U.S.C. 154(b) by 0 days.

(21) Appl. No.: 09/370,441

(22) Filed: Aug. 9, 1999

(51) Int. Cl.[7] ..... C10L 1/18

(52) U.S. Cl. ..... 585/3; 585/14; 250/339.09; 44/457; 208/16; 208/17

(58) Field of Search ..... 208/16, 17; 250/339.09; 44/451; 585/3, 14

(56) References Cited

U.S. PATENT DOCUMENTS

| | | | | |
|---|---|---|---|---|
| H1716 | * | 4/1998 | Rapp et al. | 208/17 |
| 5,223,714 | | 6/1993 | Maggard | 250/343 |
| 5,430,295 | | 7/1995 | Le Febre et al. | 250/340 |
| 5,490,085 | | 2/1996 | Lambert et al. | 364/500 |
| 5,504,331 | * | 4/1996 | Lane et al. | 250/339.09 |
| 5,512,751 | * | 4/1996 | Murray, Jr. et al. | 250/339.09 |
| 5,596,196 | | 1/1997 | Cooper et al. | 250/339.12 |
| 5,600,134 | | 2/1997 | Ashe et al. | 250/252.1 |
| 5,796,251 | | 8/1998 | Le Febre et al. | 324/300 |

FOREIGN PATENT DOCUMENTS

| | | | |
|---|---|---|---|
| 0 285 251 B1 | 8/1991 | (EP) | G01N/21/35 |
| 0 305 090 B1 | 8/1993 | (EP) | G01N/33/28 |
| 0 304 232 B1 | 12/1996 | (EP) | G01N/21/35 |

OTHER PUBLICATIONS

James M. DeJovine et al., "Gasolines Show Varied Responses to Alcohols," *Oil & Gas Journal*, Feb. 14, 1983, pp. 87–94.

Herbert O. Bailey, "Ethanol, A Major Source of Octane Number Improvement," AM–86–68, Presentation at the 1986 NPRA Annual Meeting, Mar. 23–25, 1986.

John White et al., "Gasoline Blending Optimization Cuts Use of Expensive Components," *Oil & Gas Journal*, Nov. 9, 1992, pp. 81–84.

Alain Espinosa et al., "On–Line NIR Analysis and Advanced Control Improve Gasoline Blending," *Oil & Gas Journal*, Oct. 17, 1994, pp. 49–56.

* cited by examiner

*Primary Examiner*—Jacqueline V. Howard
(74) *Attorney, Agent, or Firm*—Richard A. Kretchmer

(57) ABSTRACT

A process for controlling the composition of a subgrade gasoline so that the subgrade will yield an alcohol-containing gasoline which precisely meets desired specifications when mixed with the desired amount of alcohol. The process involves blending a plurality of blendstocks to produce a subgrade, withdrawing a sample of the subgrade, mixing it with a known amount of alcohol, analyzing the properties of the resulting mixture, and using the analysis results to control and optimize the blending process.

25 Claims, 1 Drawing Sheet

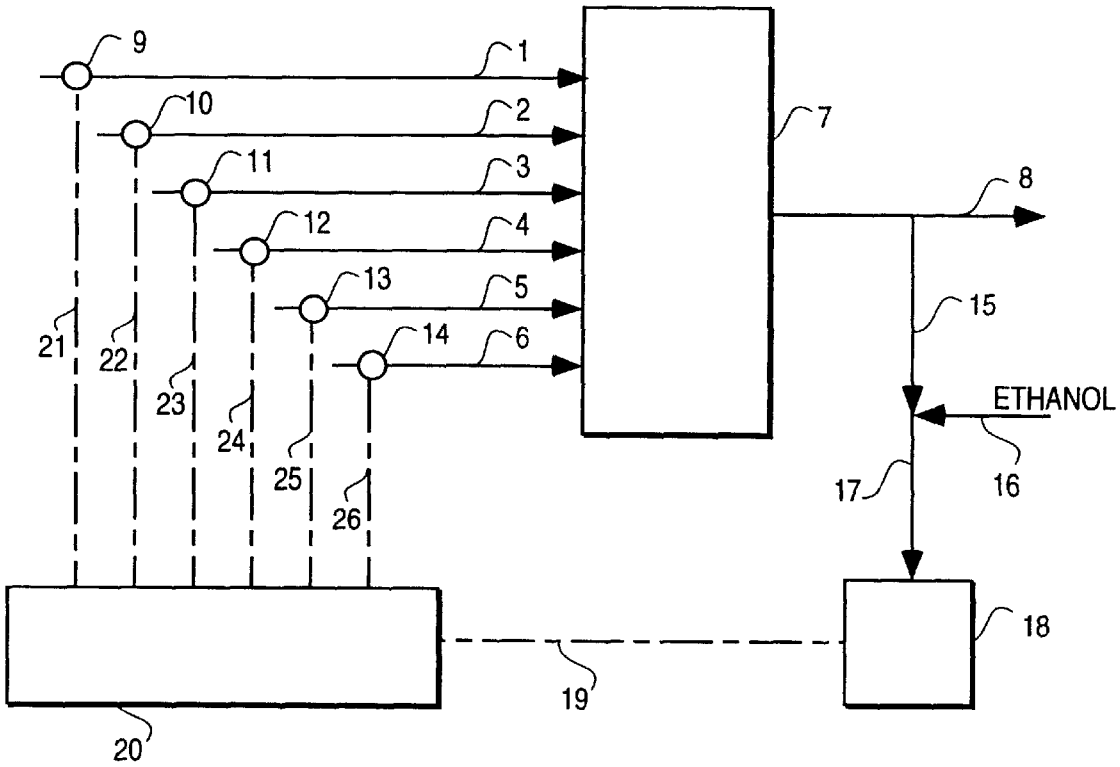
9
1
10
2
7
11
3
8
12
4
13
5
15
14
6
21
22
23
24
25
26
ETHANOL
17
16
18
19
20

PREPARATION OF ALCOHOL-CONTAINING GASOLINE

FIELD OF THE INVENTION

This invention relates to the preparation of alcohol-containing gasoline, wherein the finished gasoline is manufactured by mixing an alcohol-free precursor blend with one or more alcohols. More particularly, the invention provides an improved control over the properties of the alcohol-containing gasoline from such a process.

BACKGROUND OF THE INVENTION

Gasoline is comprised of a complex mixture of volatile hydrocarbons which is suitable for use as a fuel in a spark-ignition internal combustion engine, and it typically boils over a temperature range of about 80° to about 437° F. Although gasoline can consist of a single blendstock, such as the product from a refinery alkylation unit, it is usually comprised of a blend of several blendstocks. The blending of gasoline is a complex process, which typically involves the combination of from as few as three or four to as many as twelve or more different blendstocks to meet regulatory requirements and such other specifications as the manufacturer may select. Optimization of this blending process must take into account a plurality of characteristics of both the blendstocks and the resulting gasoline. Among others, such characteristics can include cost and various measurements of volatility, octane, and chemical composition.

It is conventional practice in the industry to blend gasoline using blendstock ratios which are determined by mathematical algorithms which are known as blending equations. Such blending equations are well known in the refining industry, and are either developed or tailored by each refiner for use in connection with available blendstocks. Blending equations typically relate the properties of a gasoline blend to the quantity of each blendstock in the blend and also to either the measured or anticipated properties of each blendstock in the blend.

Although hydrocarbons usually represent a major component of gasoline, it has been found that certain oxygen containing organic compounds can be advantageously included as gasoline components. These oxygen containing organic compounds are referred to as oxygenates, and they are useful as gasoline components because they are usually of high octane and may be a more economical source of gasoline octane than a high octane hydrocarbon blending component such as alkylate or reformate. Current government regulation in the U.S. limits the oxygen content of gasoline to 4.0 wt. % and also requires that reformulated gasolines contain at least 1.5 wt. % of oxygen. Oxygenates which have received substantial attention as gasoline blending agents include ethanol, t-butyl alcohol, methyl t-butyl ether, ethyl t-butyl ether, and methyl t-amyl ether. However, ethanol has become one of the most widely used oxygenates.

Ethanol is not usually blended into a finished gasoline within a refinery because the ethanol is water soluble. As a consequence of this solubility, an ethanol-containing gasoline can undergo undesirable change if it comes in contact with water during transport through a distribution system, which may include pipelines, stationary storage tanks, rail cars, tanker trucks, barges, ships and the like. For example, an ethanol-containing gasoline can absorb or dissolve water which will then be present as an undesirable contaminant in the gasoline. Alternatively, water can extract ethanol from the gasoline, thereby changing the chemical composition of the gasoline and negatively affecting the specifications of the gasoline.

In order to avoid, as much as possible, any contact with water, ethanol-containing gasoline is usually manufactured by a multi-step process wherein the ethanol is incorporated into the product at a point which is near the end of the distribution system. More specifically, gasoline which contains a water soluble alcohol, such as ethanol, is generally manufactured by producing an unfinished and substantially hydrocarbon precursor blend at a refinery, transporting the unfinished blend to a product terminal in the geographic area where the finished gasoline is to be distributed, and mixing the unfinished blend with the desired amount of alcohol at the product terminal. A substantially hydrocarbon precursor blend which can be converted to a finished gasoline by mixing with one or more alcohols is referred to herein either as a "subgrade" or as a "subgrade blend." The combination of the subgrade with the alcohol yields a finished gasoline which meets all specifications for sale. The subgrade is commonly called a RBOB (Reformulated Blendstock for Oxygenate Blending) when the subgrade is destined for a reformulated gasoline market in the U.S.

When a subgrade is manufactured at a refinery, the subgrade's properties are measured and controlled to intermediate specifications that differ from the finished gasoline. Intermediate specifications are use to compensate for the effects of alcohol which will be added to the subgrade after it leaves the refinery. However, the effects of alcohols such as ethanol and methanol are variable and depend on the chemical composition of the subgrade. For example, the addition of ethanol has a substantial effect on gasoline volatility, and the magnitude of this effect is dependent on the chemical composition of the subgrade blend. The addition of ethanol to gasoline affects the distillation curve of the resulting product by reducing the evaporation temperatures of the front end, which affects primarily the first 50% evaporated. Ethanol generally depresses the boiling point of aromatic hydrocarbons slightly less than that of aliphatic hydrocarbons. In addition, blending ethanol into gasoline results in a nonideal solution that does not follow linear blending relationships. Rather than lowering the vapor pressure of the resulting blend, ethanol causes an increase in the vapor pressure.

The variable and somewhat unpredictable effects which result when an alcohol, such as ethanol, is mixed with a subgrade blend to form a finished gasoline are taken into account by setting more stringent specifications for the finished gasoline than are ordinarily required. These more stringent specifications include a margin for error to accommodate the variable effect of the alcohol. Because of the margin for error, the desired specifications for the finished gasoline are usually exceeded. Unfortunately, this can add cost to the manufacturing process since expensive blendstocks may be required to achieve the margin for error.

Ethanol-free gasoline is typically produced within a refinery as a finished product which fully meets all necessary specifications for sale. This finished gasoline can be manufactured to very precisely fit the specifications because analytical data for the product can be used to control the blending process. As a consequence, manufacturing costs are kept to a minimum because expensive blendstocks are never wasted through exceeding specifications. Unfortunately, this type of precise manufacturing control is not presently possible with respect to an ethanol-containing gasoline which is prepared by mixing a subgrade blend with ethanol.

SUMMARY OF THE INVENTION

Ethanol-containing gasoline is manufactured by a two step process which comprises manufacturing an ethanol-free subgrade blend in a refinery, transporting the subgrade to a product terminal in the geographic area where the finished gasoline is to be distributed, and preparing the finished gasoline at the product terminal by mixing the subgrade with the desired amount of ethanol. Unfortunately, ethanol has a somewhat unpredictable effect on the octane and volatility of the resulting mixture. As a result, it is difficult to produce an ethanol-containing gasoline by this multi-step procedure which has the precise octane and volatility specifications which are desired. Accordingly, there is a need for a process which provides better control over the specifications of an alcohol-containing gasoline which is prepared by adding an alcohol, such as ethanol, to a subgrade blend.

We have found that the composition of a subgrade can be controlled to yield a gasoline which precisely meets desired specifications when mixed with the desired amount of alcohol by a simple modification of the blending process that is used to produce the subgrade. The modified process involves withdrawing a sample of the subgrade, mixing it with a known amount of alcohol, analyzing properties of the mixture, and using the analysis results to control and optimize the blending process.

One embodiment of the invention is an improved process for preparing an alcohol-free subgrade blend which can be converted to an alcohol-containing gasoline of desired specifications by mixing the subgrade with a desired amount of alcohol, wherein a plurality of blendstocks are mixed to yield the subgrade, and wherein the improvement comprises: (a) preparing an analytical sample by withdrawing a sample of the subgrade and mixing it with a known amount of alcohol; (b) analyzing the analytical sample to obtain a measurement of at least one property which is a subject of said specifications; and (c) using said measurement to control and optimize the process to produce a subgrade which will yield said gasoline of desired specifications when mixed with said desired amount of alcohol.

Another embodiment of the invention is an improved process for preparing an alcohol-containing gasoline of desired specifications, wherein an alcohol-free subgrade blend is prepared by mixing a plurality of blendstocks, wherein the subgrade is subsequently mixed with the desired amount of alcohol to yield said gasoline, and wherein the improvement comprises:

(a) preparing a subgrade blend by mixing a plurality of blendstocks in a blending process which comprises:
  (1) preparing an analytical sample by withdrawing a sample of the subgrade and mixing it with a known amount of alcohol;
  (2) analyzing the analytical sample to obtain a measurement of at least one property which is a subject of said specifications;
  (3) using said measurement to control and optimize the blending process to produce a subgrade which will yield said gasoline of desired specifications when mixed with said desired amount of alcohol; and
(b) mixing at least a portion of the subgrade blend with the desired amount of alcohol to yield a finished gasoline.

An object of the invention is to provide an improved method for producing a subgrade blend for subsequent conversion to an alcohol-containing gasoline.

An object of the invention is to provide an improved method for producing a subgrade blend for subsequent conversion to an ethanol-containing gasoline.

An object of the invention is to provide a method for producing a subgrade blend which will yield a gasoline of precisely known volatility and octane characteristics when mixed with the desired amount of ethanol.

An object of the invention is to provide a manufacturing process which will yield a lower cost subgrade blend.

Another objective of the invention is to provide an improved method for producing an ethanol-containing gasoline from a subgrade blend.

Another object of the invention is to provide a method which will provide better control over the volatility and octane of an ethanol-containing gasoline that is prepared by mixing ethanol with a subgrade blend.

A further object of the invention is to provide a manufacturing process which will yield a lower cost ethanol-containing gasoline.

BRIEF DESCRIPTION OF THE DRAWING

The drawing is a schematic representation of an embodiment of the invention.

DETAILED DESCRIPTION OF THE INVENTION

In the conventional manufacture of gasoline which contains a low molecular weight alcohol such as ethanol, a plurality of blendstocks are combined, on the basis of analytical data for the blendstocks, to yield a subgrade blend which is subsequently mixed with the desired amount of alcohol to yield a finished gasoline which meets all necessary specifications for sale. However, because low molecular weight alcohols have a somewhat unpredictable effect on the octane and volatility of the resulting mixture, it has been impossible to consistently produce a subgrade which will yield a finished gasoline of exactly the desired specifications when it is mixed with the desired amount of such alcohols. As a consequence, it has been necessary to produce a subgrade which provides a margin for error. Unfortunately, this margin for error frequently results in a finished gasoline which has more stringent specifications than those which are actually desired. Since octane is one typical specification, the need to provide a margin for error frequently results in a finished product which has a higher than necessary octane and an associated higher manufacturing cost.

The conventional margin for error ensures that the required specifications for the finished gasoline are met, and its magnitude is generally set at value which is at least as large as the variability of the effect of the alcohol on the property in question. This property can include, but is not limited to, octane, Reid vapor pressure, Driveability Index ("DI"), wt. % oxygen, and distillation properties such as the 10% distillation point ("T10"), the 50% distillation point ("T50"), and the 90% distillation point ("T90") as defined by the ASTM D 86–95 procedure, which can be found in the 1996 Annual Book of ASTM Standards, Section 5, Petroleum Products, Lubricants, and Fossil Fuels, or by conventional alternative procedures.

Any alcohol or mixture of alcohols can be used in the practice of this invention. However, monohydric aliphatic alcohols are usually most typical of the alcohols which are currently employed commercially in the manufacture of alcohol-containing gasoline. Alcohols which contain from 1 to about 10 carbon atoms can be conveniently used. Desirable alcohols will contain from 1 to 5 carbon atoms, and preferred alcohols will contain from 1 to 4 carbon atoms. For example, the alcohol of the alcohol-containing gasoline of this invention can be comprised of at least one compound which is selected from the group consisting of methanol, ethanol, 1-propanol, 2-propanol, 1-butanol, 2-butanol, 2-methyl-1-propanol, and 2-methyl-2-propanol. Methanol and ethanol are highly satisfactory alcohols for use in the practice of this invention.

In the practice of this invention, the finished alcohol-containing gasoline can be prepared by mixing any desired amount of alcohol with the alcohol-free subgrade. For example, the finished gasoline could contain 1%, 10%, 50%, or any other amount of alcohol that might be desired. However, it will be appreciated that the invention will typically be most useful in manufacturing alcohol-containing gasoline for distribution to motorists. Accordingly, the finished alcohol-containing gasoline will usually contain an amount of alcohol which yields an oxygen content which conforms to any applicable government regulation. For example, current government regulation in the U.S. limits the oxygen content of gasoline to 4.0 wt. %.

A finished gasoline which is prepared by mixing a subgrade with ethanol has an octane which is dependent upon: (1) the ratio of ethanol to subgrade, and (2) the octane and composition of the subgrade. The effect of subgrade octane and composition on the octane of the finished gasoline is set forth in Table I for a group of four different subgrades upon mixing with 10 vol. % of ethanol. Each of the subgrades in the tabulation has a different composition and octane. When a finished gasoline was prepared by mixing each of the subgrades with 10 vol. % ethanol, the octane difference or bonus (referred to as "Δ-Octane" in Table I) between the finished gasoline and the subgrade was not constant and ranged from 2.4 to 3.6. Octane is conventionally measured as research octane, or as motor octane, or as the sum of the research and motor octane divided by 2 [referred to herein as "(R+M)/2"]. Subgrades of other composition and octane can yield an even wider range of Δ-Octane upon blending with ethanol.

TABLE I

| | Subgrade Blend | | | |
|---|---|---|---|---|
| | A | B | C | D |
| Composition | | | | |
| Olefins, vol. % | 7.5 | 1.0 | 4.0 | 10.0 |
| Aromatics, vol. % | 6.5 | 6.0 | 7.0 | 21.0 |
| Benzene, vol. % | 0.5 | 0.4 | 0.2 | 1.1 |
| Sulfur, ppm | 85 | 88 | 87 | 177 |
| Volatility | | | | |
| RVP, psi | 11.6 | 11.5 | 12.8 | 11.2 |
| T10, ° F. | 125 | 107 | 100 | 113 |
| T50, ° F. | 197 | 189 | 187 | 179 |
| T90, ° F. | 303 | 268 | 293 | 328 |
| Octane | | | | |
| Subgrade, (R + M)/2 | 91.6 | 91.8 | 92.2 | 84.7 |
| Subgrade + 10 vol. % Ethanol, (R + M)/2 | 94.0 | 94.8 | 94.9 | 88.3 |
| Δ-Octane, (R + M)/2 | 2.4 | 3.0 | 2.7 | 3.6 |

Using the examples from Table I and a conventional blending approach, the intermediate specification for octane could be based on the expectation that the lower end of the range of Δ-Octane, 2.4, would be realized after adding 10 vol. % ethanol. For subgrade B, the actual Δ-Octane was 3.0, which exceeded the expected value by 3.0−2.4=0.6. This difference of 0.6 is the octane margin for error with respect to subgrade B, and is an example of the savings that can be realized by the practice of this invention. The present invention permits a decrease in the intermediate octane target for subgrade B by as much as 0.6 (R+M)/2. That is to say, the margin for error can be significantly reduced or substantially eliminated through the practice of this invention.

The use of an octane margin for error in the conventional manufacture of a subgrade blend imposes an increased manufacturing cost because it usually requires the use of additional amounts of relatively expensive blendstocks. For example, a typical octane cost is about $0.42 per barrel for one unit of octane, where a barrel is equal to forty-two gallons, a gallon being two hundred and thirty-one cubic inches, measured at 60° F., and where octane is measured as (R+M)/2. This cost represents the additional usage of more expensive blendstocks which have higher octane. If 50,000 barrels per day of subgrade are manufactured in a refinery, the savings which can be realized by decreasing the subgrade octane margin for error by an average of 0.6 (R+M)/2 are about $4,600,000 per year.

This invention provides an improved process by which a subgrade blend can be produced which will yield a finished gasoline of exactly the desired specifications when mixed with the desired amount of alcohol. In the practice of this invention, the subgrade is sampled, the sample mixed with a known amount of alcohol to produce an analytical sample which can be used to determine the properties of the finished gasoline that will be obtained from the subgrade upon blending with alcohol, the analytical sample is analyzed with respect to at least one of the specifications for the finished gasoline, and the analytical results are used to control and optimize the blending of the subgrade. Because the effect of the alcohol is accounted for in the analysis, the composition of the subgrade can be precisely adjusted so that it will yield a finished gasoline of exactly the desired specifications when mixed with alcohol. This has the result of reducing the manufacturing cost of both the subgrade and the finished gasoline.

The amount of alcohol that is used in preparing the analytical sample can be different from that which is used in preparing the finished gasoline by blending a desired amount of alcohol with the subgrade. The response of the subgrade to a known amount of alcohol can be used as a basis to calculate the response of the subgrade to a different amount of alcohol which is mixed with the subgrade to yield the finished gasoline. That is to say, measurement of the subgrade's response to alcohol at one concentration can be used to accurately determine its response when mixed with a different amount of alcohol, for example, the desired amount to prepare the finished alcohol-containing gasoline. In the case of an octane specification for an ethanol-containing gasoline, if the ethanol/subgrade ratio of the analytical sample is lower than the target ratio for the finished gasoline that is to be manufactured from the subgrade, the octane analysis will be adjusted to reflect the fact that the finished gasoline will have a higher ethanol content. Typically, this will involve an upward adjustment of the octane analysis in view of ethanol's high octane relative to that of most conventional blendstocks. The magnitude of the adjustment will be dependent upon the amount of deviation of the ethanol/subgrade ratio of the analytical sample from the target ratio for the finished gasoline that is to be manufactured from the subgrade. If the ethanol/subgrade ratio of the analytical sample exactly matches that for the finished gasoline that is to be produced from the subgrade, no adjustment will be necessary.

The process of this invention can be carried out using an analytical sample which possesses an alcohol/subgrade ratio that can vary over wide range, and this ratio can be substantially different from that which is intended for the finished gasoline that is to be prepared from the subgrade. For example, the volumetric ratio of these two materials can have any value over the range from about 0.01 to about 0.90.

However, it is preferable to use a volumetric ratio that is somewhat near that which is intended for the finished gasoline that is to be prepared from the subgrade blend. For example, if the finished gasoline is to contain 10.0 vol. % ethanol, which represents a volumetric ethanol/subgrade ratio of 0.111, the analytical sample would desirably have a volumetric ethanol/subgrade ratio in the range from about 0.06 to about 0.16, preferably in the range from about 0.08 to about 0.14, more preferably in the range from about 0.09 to about 0.13, and most preferably about 0.11. The closer the composition of the analytical sample is to that of the finished gasoline that is to be prepared from the subgrade blend, the smaller the correction that must be made to the analytical results in order to properly adjust and control the blending process to yield the desired subgrade. A small correction will generally yield a more accurate result than a larger correction.

If desired, the subgrade blend can be prepared in a batch process, with the analytical data for a mixture of the subgrade with alcohol being used to adjust and control the final composition of the subgrade. However, in a preferred embodiment of the invention, the subgrade blend is prepared in a substantially continuous process wherein a large volume of subgrade is prepared by continuously blending over a period of time (for example, a period of at least 10 minutes, preferably at least 30 minutes, and more preferably at least an hour) a plurality of blendstocks, and wherein analytical data for a mixture of the subgrade with the alcohol is used to adjust and control the composition of the subgrade. In such a substantially continuous process, analytical samples can be prepared and analyzed periodically. Alternatively, in such a substantially continuous process, analytical samples can be prepared on a continuous or substantially continuous basis. For example, a preferred procedure involves continuously withdrawing a small slip-stream from the subgrade as it is produced and continuously mixing this slip-stream with a stream of alcohol which provides a known amount of alcohol in the resulting mixture. The fluid streams that are mixed to yield the analytical sample product stream can be metered and controlled through the use of any conventional procedure or device, for example, through the use of calibrated metering pumps. Analytical data for this continuously prepared analytical sample can then be measured as frequently as desired, for example, the sampling interval can range from as little as about 1 to 5 seconds to as much as about 5 to 10 minutes. For example, a sampling interval in the range from about 30 to about 120 seconds is frequently convenient. The resulting data is used to control and optimize the blending process to produce a subgrade which will yield a gasoline of precisely the desired specifications when mixed with the desired amount of alcohol. In a highly preferred embodiment, a computer and conventional control software are used to control and optimize the proportion of the blendstocks in the resulting subgrade on the basis of the analytical data.

Any conventional blending procedure which uses analytical data for a process stream to control the properties of the resulting blend can be used in the practice of this invention. It is conventional to use analytical data for at least one process stream to produce a fuel blend of desired properties, and it is also conventional to use computer control for such a process. A preferred blending process for use in the practice of the invention involves the use of analytical data for each of the blendstocks to control the process. The subject invention can be used to improve any such blending process when used to produce a subgrade blend. For example, a gasoline blending process is described in an article by Espinosa et al. entitled "On-Line NIR Analysis and Advanced Control Improve Gasoline Blending" (*Oil & Gas Journal,* Oct. 17, 1994, pages 49–56) which employs a centralized near-infrared spectrometer to gather analytical data for the various process streams and uses the data to adjust the blendstock flow rates to meet target specifications for the product blend through the use of control software. This article is incorporated herein in its entirety. The subject invention can be advantageously used to improve the blending process of the Espinosa et al. article when the process is used to manufacture a subgrade blend.

Conventional blending procedures which involve analyzing one or more process streams of a blending process and using the resulting analytical data to control the properties of the resulting blend are also described, for example, in U.S. Pat. No. 5,223,714 (Maggard); U.S. Pat. No. 5,430,295 (Le Febre et al.); U.S. Pat. No. 5,490,085 (Lambert et al.); U.S. Pat. No. 5,596,196 (Cooper et al.); U.S. Pat. No. 5,600,134 (Ashe et al.); and U.S. Pat. No. 5,796,251 (Le Febre et al.). Each of these patents is incorporated herein in its entirety. This invention can be advantageously used to improve any such blending process when the process is used to manufacture a subgrade blend. U.S. Pat. No. 5,223,714 (Maggard); U.S. Pat. No. 5,430,295 (Le Febre et al.); and U.S. Pat. No. 5,490,085 (Lambert et al.) disclose the use of data obtained by near-infrared spectroscopy to control the composition of a product which is obtained by blending two or more components. U.S. Pat. No. 5,596,196 (Cooper et al.) discloses the use of Raman near-infrared spectroscopy and multivariate analysis to control the concentration of one or more oxygenated components, such as alcohols, in a liquid mixture of hydrocarbons with one or more oxygenated component. U.S. Pat. No. 5,600,134 (Ashe et al.) discloses a method for controlling the preparation of a blend, such as motor gasoline, from blend stocks through the use of data obtained from a combination of gas chromatography and mass spectrometry. U.S. Pat. No. 5,796,251 (Le Febre et al.) discloses a method for controlling the blending of components to produce a blend, such as gasoline, which involves using data obtained by nuclear magnetic resonance spectroscopy.

The analytical sample of this invention, which is prepared by withdrawing a small sample of the subgrade and mixing it with a known amount of alcohol, is analyzed with respect to at least one property of the finished gasoline. Such properties include, but are not limited to research octane, motor octane, (R+M)/2, Reid vapor pressure, Driveability Index ("DI"), wt. % oxygen, distillation properties (such as T10, T50, T90, and final boiling points, and also properties such as vol. % off at 100° F. and vol. % off at 200° F.), olefin content, paraffins content, aromatics content, benzene content, and sulfur content. However, research octane, motor octane, and (R+M)/2 will be of particular importance in preparing a subgrade that can be converted to a finished alcohol-containing gasoline of known octane.

Any conventional analytical procedure can be utilized to analyze the analytical sample of this invention. Near-infrared spectroscopy is generally a satisfactory procedure that can be used to measure a variety of properties which include, but are not limited to, motor octane, research octane, (R+M)/2, distillation parameters, olefin content, aromatics content, and benzene content. For example, European Patent Specification 0 285 251 B1 discloses a method for the determination of the octane number of a multicomponent hydrocarbon based fuel from its near-infrared absorption spectrum in the wave number spectral range from 6667 to 3840 $cm^{-1}$ by selecting a number (n) of frequencies within this range and correlating the (n) absorbance values with octane number through multivariate regression analysis. European Patent Specification 0 305 090 B1 also discloses a method for the determination of physical properties of a multi-component hydrocarbon based fuel through a correlation of near infra-red absorbance data for the fuel with its physical properties. Gas chromatography can be used to measure properties such as distillation parameters, aromatics content, and benzene content. An octane engine can be used to measure octane, and an RVP analyzer can be used to measure RVP. Other test methods include, but are not limited to, fluorescent indicator adsorption (FIA) measurement of olefins and aromatics, determination of volatility characteristics by distillation in accordance with the ASTM D 86-95 procedure, measurement of sulfur content by X-ray fluorescence. Mass spectrometry and nuclear magnetic resonance spectroscopy are also conventional analytical procedures which can be used in the practice of this invention.

In a preferred embodiment of the invention, the analytical sample of this invention is analyzed using an on-line analyzer. Suitable on-line analyzers include, but are not limited to, near-infrared and gas chromatography analyzers. Near-infrared on-line analyzers are highly satisfactory and, for example, operate by measuring the near-infrared absorption of the analytical sample and correlating the selected absorbance values which are obtained with the property in question of the sample. For example, this correlation can be carried out by multivariate regression analysis.

In the practice of this invention, the analytical data obtained from the analytical sample is used to control and optimize the blending process to produce a subgrade which will yield a finished gasoline of desired specifications when mixed with the desired amount of the selected alcohol or alcohols. If desired, the control and optimization can be carried out under manual control. However, in a highly preferred embodiment of the invention, the analytical data will transmitted to a computer which uses appropriate software to adjust the flow rate of the various blendstocks in order to control and optimize the blending process to produce a subgrade which will yield a finished gasoline of precisely the desired specifications when mixed with the desired amount of the selected alcohol or alcohols. In a preferred embodiment, at least one property of the analytical sample will be measured which is selected from the group consisting of octane, vapor pressure, distillation properties, density, oxygen content, olefin content, paraffin content, aromatics content and benzene content, and the result will be used to control and optimize the blending process. In a highly preferred embodiment, the octane of the analytical sample will be measured and the result used to control and optimize the blending process.

In a computer controlled blending process, analytical data from the analytical sample of this invention is transmitted to a control program which comprises blending algorithms which adjust the analytical results when the alcohol/subgrade ratio of the analytical sample varies from that of the desired target ratio for the finished gasoline. For example, in the case of an octane specification, if the alcohol/subgrade ratio of the analytical sample is lower than the target ratio for the finished gasoline that is to be manufactured from the subgrade, the algorithms will adjust the octane analysis to reflect the fact that the finished gasoline will have a higher alcohol content. In the case of ethanol, this will typically involve an upward adjustment of the octane analysis in view of ethanol's high octane relative to that of most conventional blendstocks. The magnitude of the adjustment will be dependent upon the amount of deviation of the alcohol/subgrade ratio of the analytical sample from the target ratio for the finished gasoline that is to be manufactured from the subgrade. If the alcohol/subgrade ratio of the analytical sample exactly matches that for the finished gasoline which is to be produced from the subgrade, the blending algorithms of the control program will make no adjustment.

In a computer controlled blending process, the control program will also comprise blending algorithms which will adjust the composition of the subgrade based on the analytical results that are transmitted to it. Such control programs and blending algorithms are conventional and are not a part of the present invention. The adjustment of the subgrade composition is conveniently carried out by adjusting the relative amounts of the various blendstock which are used or by changing the blending recipe. For example, if analysis of the analytical sample indicates that the finished gasoline will have an octane which is below the target value, the octane of the subgrade could be increased by increasing the amount of one or more of the higher octane blendstocks which are being used in its manufacture. As the octane of the subgrade increases, that of the finished gasoline will also increase.

Conventional blendstocks which can be used in the manufacture of a subgrade blend in accordance with the invention include, but are not limited to, catalytically cracked naphtha, reformate, virgin naphtha, isomerate, alkylate, raffinate, natural gasoline, polymer gasoline, pyrolysis gasoline, pentane, butane, xylene, and toluene. Preferably, the subgrade will be comprised of at least 80 vol. % of a mixture of hydrocarbons. A fuel-grade ethanol, which typically contains about 95% ethanol in combination with a denaturant, is added to the subgrade blend to produce a finished ethanol-containing gasoline.

In a preferred embodiment of the invention, the optimized subgrade composition is transported to a blending site which is: (1) geographically proximate to the area in which the finished alcohol-containing gasoline is to be distributed for use, and (2) geographically distant from the place where the subgrade is prepared. The finished gasoline is then prepared by mixing the subgrade with the desired amount of alcohol at said blending site.

One embodiment of the invention is schematically illustrated in the drawing. With reference to the drawing, a separate blendstock is passed through each of input lines 1, 2, 3, 4, 5, and 6. Each of input lines 1–6 discharges into blending chamber 7 in which the blendstocks are mixed to form a subgrade blend which can subsequently be converted to an ethanol-containing finished gasoline of desired specifications by mixing with a desired amount of ethanol. Although six input lines are shown in the drawing, it will be appreciated that a larger or smaller number can be used if desired. The resulting subgrade blend is discharged from blending chamber 7 through output line 8, and is passed to a suitable storage facility such as a holding tank or to an element of a distribution system such as a pipeline, rail car, tanker truck or barge (such storage facility or element of a distribution system is not shown in the drawing). Each of the input lines 1–6 is provided with an associated metering device 9, 10, 11, 12, 13, and 14, respectively, and each metering device is comprised of a flow rate sensor and flow control valve.

A sample of the subgrade blend is withdrawn through sampling line 15 and combined with a known amount of ethanol from input line 16 to provide an analytical sample which is passed through line 17 to analytical device 18. Although the subgrade sample can be withdrawn on a periodic basis and combined with a known aliquot of ethanol, a preferred embodiment involves the continuous withdrawal of a sample stream of known volume through sampling line 15 which is combined with a continuous ethanol stream of known volume from line 16. In the event that the analytical sample is prepared by withdrawing a continuous sample stream through line 15 and combining it with a known amount of ethanol from input line 16, any conventional fluid control equipment can be used to provide an analytical sample which contains a known amount of both the subgrade sample and of ethanol. For example, calibrated metering pumps can be used. That is to say, a syringe pump or peristaltic pump can be used for the ethanol stream, and a peristaltic pump can be used for the subgrade sample stream. In the event that the analytical sample is prepared by periodically withdrawing a sample of the subgrade blend and combining it with a known amount of ethanol, any conventional equipment can be used which will deliver known amounts of both the subgrade sample and of ethanol. For example, calibrated metering pumps can be used, such as a syringe pump or peristaltic pump for the ethanol and a peristaltic pump for the subgrade sample. Alternatively, syringe or pipette or automatic dispenser type devices can be used to accurately combine known volumes of both the subgrade sample and of ethanol.

Analytical device 18 can be any analytical device which is capable of measuring the property of the analytical sample which is of interest. Such properties can include, but are not limited to, motor octane, research octane, (R+M)/2, Reid vapor pressure, and distillation properties. Suitable analytical devices include, but are not limited to, near-infrared spectrometers, gas chromatographs, mass spectrometers, nuclear magnetic resonance spectrometers, and knock engines. Analytical device 18 is coupled by a data bus 19 to a general control system computer 20. Each of the metering devices 9–14 is similarly coupled to the computer 20 by data buses 21–26, respectively. The control system computer 20 is provided with data through data buses 21–26 regarding the flow rate of each blendstock through its input line 1–6 by means of the associated metering device 9–14, respectively. In addition, the control system computer 20 also receives through data bus 19 the analytical measurements from analytical device 18. On the basis of this input of data, the control system computer 20 varies the flow rate of the blendstocks in the input lines 1–6 by appropriate commands to the associated metering devices 9–14, in order to yield a subgrade blend which will accurately yield a finished gasoline of desired specifications when it is blended with the desired amount of ethanol.

With further reference to the drawing, and as applied to the control of the subgrade composition so that it yields a finished gasoline of the desired octane when mixed with the desired amount of ethanol, the subject invention can be carried out in the following manner. The flow rate of each blendstock through its specific input line 1–6, and therefore the amount of each blendstock, can be first set to selected values based on the refiner's experience, laboratory data, or blending equations. The analytical sample, which is conveyed to analytical device 18 through line 17, is prepared by withdrawing a sample of the subgrade blend through sampling line 15 and mixing it with a known amount of ethanol from line 16 wherein the ratio of ethanol/subgrade is exactly the same as that for the finished gasoline that is to be prepared from the subgrade. The octane of the analytical sample is then determined by measuring the near infrared absorption of the analytical sample and correlating, by means of multivariate regression analysis, the absorbance values obtained with the octane of the analytical sample. The flow rate of one blendstock through its input line, for example input line 1, can then be changed and the value of the octane number of an analytical sample prepared in the above-described manner from the modified subgrade that flows out of blending chamber 7 and through output line 8 can be again determined as described above. The flow rate through input line 1 can then be returned to its initial setting, and the flow rate through another input line 2, can be varied, and the octane of a new analytical sample, which is prepared from resulting subgrade, can then be determined in the same manner. This process can be repeated for each of the remaining input lines 3–6. Once each input line has been individually and sequentially altered and the resulting effect on the octane of the finished gasoline is known, the flow rate of one or more of the input lines can be reset according to an algorithm to afford a subgrade blend which will yield a finished gasoline having an octane which is closer to the target value than that of the initial subgrade blend. This process can be repeated until the subgrade blend yields, upon mixing with the desired amount of ethanol, a finished gasoline which has an octane which is within ±0.3 octane numbers of the desired value.

We claim:

1. In a process for preparing an alcohol-free subgrade blend which can be converted to an alcohol-containing gasoline of at least one property of known value by mixing the subgrade with alcohol, and wherein a plurality of blendstocks are mixed to yield the subgrade, the improvement which comprises:

(a) selecting the alcohol concentration which is desired in said alcohol-containing gasoline;

(b) preparing an analytical sample by withdrawing a sample of the subgrade and mixing it with a known amount of the alcohol;

(c) analyzing the analytical sample to obtain a measurement of said property; and (d) using said measurement to control and optimize the process to produce a subgrade which will said gasoline when mixed with an amount of said alcohol which will provide an alcohol-containing gasoline which contains the selected alcohol concentration.

2. The process of claim 1 wherein said alcohol is comprised of at least one compound which is selected from the group consisting of methanol, ethanol, 1-propanol, 2-propanol, 1-butanol, 2-butanol, 2-methyl-1-propanol, and 2-methyl-2-propanol.

3. The process of claim 1 wherein said alcohol is ethanol.

4. The process of claim 3 wherein said property is selected from the group consisting of octane, vapor pressure, distillation properties, density, oxygen content, olefin content, paraffin content, aromatics content and benzene content.

5. The process of claim 3 wherein the analytical sample is analyzed with respect to its octane.

6. The process of claim 5 wherein the analytical measurement is obtained by measuring the near infrared absorption of the analytical sample and correlating, by means of multivariate regression analysis, the absorbance values obtained with the octane of said analytical sample.

7. The process of claim 5 wherein the octane analysis of said analytical sample is carried out with a knock engine.

8. The process of claim 3 wherein the subgrade is prepared by continuously blending said blendstocks, analytical samples are periodically prepared at intervals in the range from about 1 second to about 10 minutes, and the analytical samples are analyzed to yield measurements which are used to control and optimize said process.

9. The process of claim 3 wherein the subgrade is prepared by continuously blending said blendstocks, analytical samples are prepared on a substantially continuous basis by continuously withdrawing a small fraction of the subgrade as it is produced and mixing said fraction with said known amount of alcohol, and the analytical samples arc analyzed to yield measurements which are used to control and optimize said process.

10. The process of claim 9 wherein the analytical sample is analyzed with respect to octane, and wherein the analytical measurement is obtained by measuring the near infrared absorption of the analytical sample and correlating, by means of multivariate regression analysis, the absorbance values obtained with the octane of the analytical sample.

11. The process of claim 10 wherein the analytical measurement is carried out on a substantially continuous basis.

12. The process of claim 3 wherein the subgrade is comprised of at least 80 vol. % of a mixture of hydrocarbons.

13. In a process for preparing an alcohol-containing gasoline of at least one property of known value, wherein an alcohol-free subgrade blend is prepared by mixing a plurality of blendstocks, and wherein the subgrade is subsequently mixed with alcohol to yield said gasoline, the improvement which comprises:

(a) preparing a subgrade blend by mixing a plurality of blendstocks in a blending process which comprises:
  (1) selecting the alcohol concentration which is desired in said gasoline;
  (2) preparing an analytical sample by withdrawing a sample of the subgrade and mixing it with a known amount of the alcohol;
  (3) analyzing the analytical sample to obtain a measurement of said property;
  (4) using said measurement to control and optimize the blending process to produce a subgrade which will yield said gasoline when mixed with an amount of said alcohol which will provide an alcohol-containing gasoline which contains the selected alcohol concentration; and (b) mixing at least a portion of the subgrade blend with the required amount of alcohol to yield a finished gasoline which contains the selected alcohol concentration.

14. The process of claim 13 wherein said alcohol is comprised of at least one compound which is selected from the group consisting of methanol, ethanol, 1-propanol, 2-propanol, 1-butanol, 2-butanol, 2-methyl-1-propanol, and 2-methyl-2-propanol.

15. The process of claim 14 wherein said alcohol is ethanol.

16. The process of claim 15 wherein said property is selected from the group consisting of octane, vapor pressure, distillation properties, density, oxygen content, olefin content, paraffin content, aromatics content and benzene content.

17. The process of claim 15 wherein the analytical sample is analyzed with respect to its octane.

18. The process of claim 17 wherein the analytical measurement is obtained by measuring the near infrared absorption of the analytical sample and correlating, by means of multivariate regression analysis, the absorbance values obtained with the octane of the analytical sample.

19. The process of claim 17 wherein the octane analysis of said analytical sample is carried out with a knock engine.

20. The process of claim 15 wherein the subgrade is transported to a blending site which is geographically proximate to the area in which said finished gasoline is distributed for use and geographically distant from the place where the subgrade is prepared, and wherein said finished gasoline is prepared by mixing the subgrade with the required amount of alcohol at the blending site.

21. The process of claim 15 wherein the subgrade is prepared by continuously blending said blendstocks, analytical samples are periodically prepared at intervals in the range from about 1 second to about 10 minutes, and the analytical samples are analyzed to yield measurements which are used to control and optimize the blending process.

22. The process of claim 15 wherein the subgrade is prepared by continuously blending said blendstocks, analytical samples are prepared on a substantially continuous basis by continuously withdrawing a small fraction of the subgrade as it is produced and mixing said fraction with said known amount of alcohol, and the analytical samples are analyzed to yield measurements which are used to control and optimize said process.

23. The process of claim 22 wherein the analytical sample is analyzed with respect to octane, and wherein the analytical measurement is obtained by measuring the near infrared absorption of the analytical sample and correlating, by means of multivariate regression analysis, the absorbance values obtained with the octane of the analytical sample.

24. The process of claim 23 wherein the analytical measurement is carried out on a substantially continuous basis.

25. The process of claim 15 wherein the subgrade is comprised of at least 80 vol. % of a mixture of hydrocarbons.

* * * * *

UNITED STATES PATENT AND TRADEMARK OFFICE

CERTIFICATE OF CORRECTION

PATENT NO. : 6,258,987 B1
DATED : July 10, 2001
INVENTOR(S) : Gerald K. Schmidt, Ken Tadano It is certified that error appears in the above-identified patent and that said Letters Patent is hereby corrected as shown below:

Column 2,
Line 23, "are use to compensate for" should read -- are used to compensate for --

Column 8,
Line 46, "limited to research octane," should read -- limited to, research octane, --

Column 9,
Line 37, "will transmitted to a computer" should read -- will be transmitted to a computer --

Column 12,
Line 39, "which will said gasoline" should read -- which will yield said gasoline --

Signed and Sealed this

Twentieth Day of November, 2001

*Attest:*

Nicholas P. Godici

NICHOLAS P. GODICI

*Attesting Officer*

*Acting Director of the United States Patent and Trademark Office*